US006318448B1

(12) United States Patent
Fehlemann

(10) Patent No.: US 6,318,448 B1
(45) Date of Patent: Nov. 20, 2001

(54) MOLD WALL OF A CONTINUOUS CASTING MOLD

(75) Inventor: Gereon Fehlemann, Düsseldorf (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/328,618

(22) Filed: Jun. 9, 1999

(30) Foreign Application Priority Data

Jun. 15, 1998 (DE) ..... 198 26 522

(51) Int. Cl.[7] ..... B22D 11/00; B22D 33/04
(52) U.S. Cl. ..... 164/418; 164/348; 164/341
(58) Field of Search ..... 164/418, 443, 164/485, 348, 339, 341, 137

(56) References Cited

U.S. PATENT DOCUMENTS 4,009,749 * 3/1977 Alberny ..... 164/147
4,224,977 * 9/1980 Cygler et al. ..... 164/82
4,715,425 * 12/1987 Brosch ..... 164/418
5,785,112 * 7/1998 Carrupt et al. ..... 164/472

* cited by examiner

*Primary Examiner*—Nam Ngyuen
*Assistant Examiner*—I.-H. Lin
(74) *Attorney, Agent, or Firm*—Friedrich Kueffner

(57) ABSTRACT

A mold wall of a continuous casting mold includes an inner mold plate and a water box connected to the inner mold plate through screw connections, wherein the inner mold plate has on its side facing the water box webs with grooves extending between the webs, and wherein filler pieces are arranged in the grooves. The filler pieces each have at least one expanding element for producing a frictionally engaging connection of the filler pieces to the inner mold plate. The screw connections are arranged between the water box and the filler pieces.

4 Claims, 2 Drawing Sheets

MOLD WALL OF A CONTINUOUS CASTING MOLD

BACKGROUND OF THE INVENTION

1. Field of the Invention

The present invention relates to a mold wall of a continuous casting mold. The mold wall includes an inner mold plate and a water box connected to the inner mold plate through screw connections, wherein the inner mold plate has on its side facing the water box webs with grooves extending between the webs, and wherein filler pieces are arranged in the grooves.

2. Description of the Related Art

A mold wall of the above-described type is generally known in the art. The grooves serve as cooling ducts for a cooling liquid, usually water. The filler pieces serve to reduce the cross-section of the ducts so that the flow velocity of the cooling liquid in the cooling ducts is increased. However, the filler pieces do not serve a supporting function. The inner mold wall is fastened to the water box through a plurality of screws which extend at least partially through the water box and are screwed into threaded pieces which are arranged in the inner mold wall.

The mold wall of the prior art has several disadvantages. In particular, the mounting of the threaded pieces in the inner mold plate is very complicated. In addition, the inner mold plate is usually of copper, while the threaded pieces are of steel. Consequently, when a worn inner mold plate is to be replaced, a large quantity of contaminated copper must be treated in a complicated process to be able to reuse the copper.

SUMMARY OF THE INVENTION

Therefore, it is the primary object of the present invention to provide a mold wall of a continuous casting mold which does not have the disadvantages of the prior art.

In accordance with the present invention, the filler pieces each have at least one expanding element for producing a frictionally engaging connection of the filler pieces to the inner mold plate. The screw connections are arranged between the water box and the filler pieces.

As a result of the configuration of the mold wall according to the present invention, the inner mold plate, which is a component which is subject to wear, only has to have the webs for forming the cooling ducts. Further processing of the inner mold plate, particularly mounting the screw connections in the inner mold plate, is not necessary. When this component "inner mold plate" which is subject to wear is disassembled, the elimination of the frictional engagement results in an automatic separation of the inner mold plate of copper from the steel components. Accordingly, it is now much easier to reuse the inner mold plate.

In accordance with a particularly simple structural development of the expanding element, the expanding element has at least one conically tapered expanding plate which can be pressed by means of a screw against one of the webs.

The expanding element can be expanded, for example, by means of a conically tapered expanding disc which is arranged between the screw and the expanding plate. As an alternative or as an additional feature, the screw may conically taper at least in a partial section thereof.

By providing a spring element for the expanding element it is ensured that the frictional engagement between the filler pieces and the webs is maintained even when the mold wall is heated.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
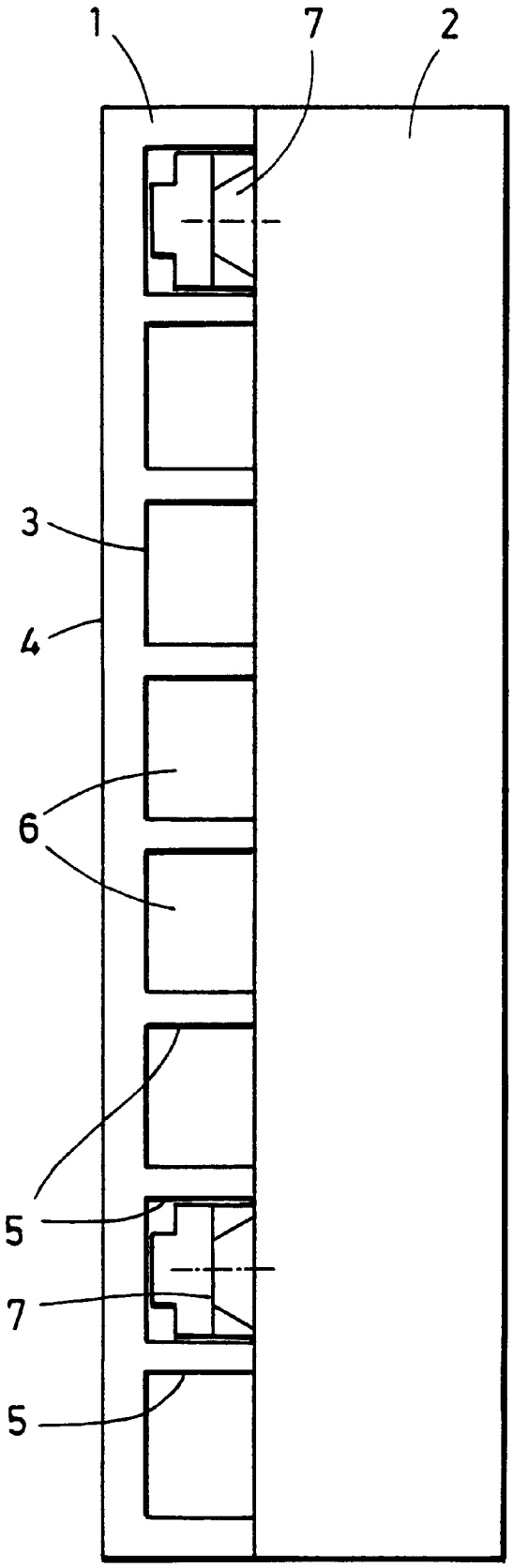
FIG. 1 is a schematic illustration of a mold wall of a continuous casting mold.

As illustrated in FIG. 1 of the drawing, a mold wall of a continuous casting mold is composed of an inner mold plate 1 and a water box 2. The inner mold plate 1 has an inner side 3 and an outer side 4. During the operation of the continuous casting mold, the outer side 4 of the inner mold plate 1 faces the liquid metal to be cast, particularly steel. The inner side 3, on the other hand, faces the water box 2. The inner mold plate 1 is connected to the water box 2 through screw connections. The screw connections are indicated in FIG. 1 by dash-dot lines.

Figure 2:
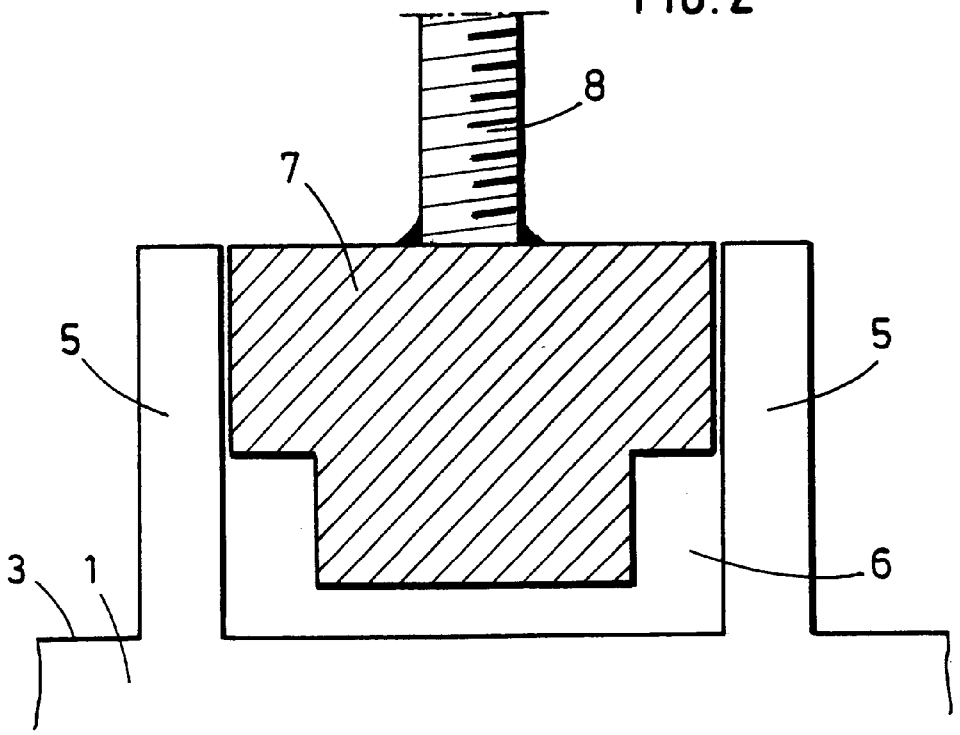
FIG. 2 is an illustration, partially in section, of a screw connection.

The inner mold plate 1 is provided on its inner side 3 with perpendicularly extending webs 5. Consequently, grooves 6 extend between the webs 5. As can be seen particularly clearly in FIG. 2, filler pieces 7 are arranged in the grooves 6. Threaded bolts 8 are welded to the filler pieces 7. The filler pieces and, thus, also the inner mold plate 1 as will be described below, are screwed to the water box 2 by means of the threaded bolts 8. Consequently, the screw connections between the inner mold plate 1 and the water box 2 are arranged between the filler pieces 7 and the water box 2.

Figure 3:
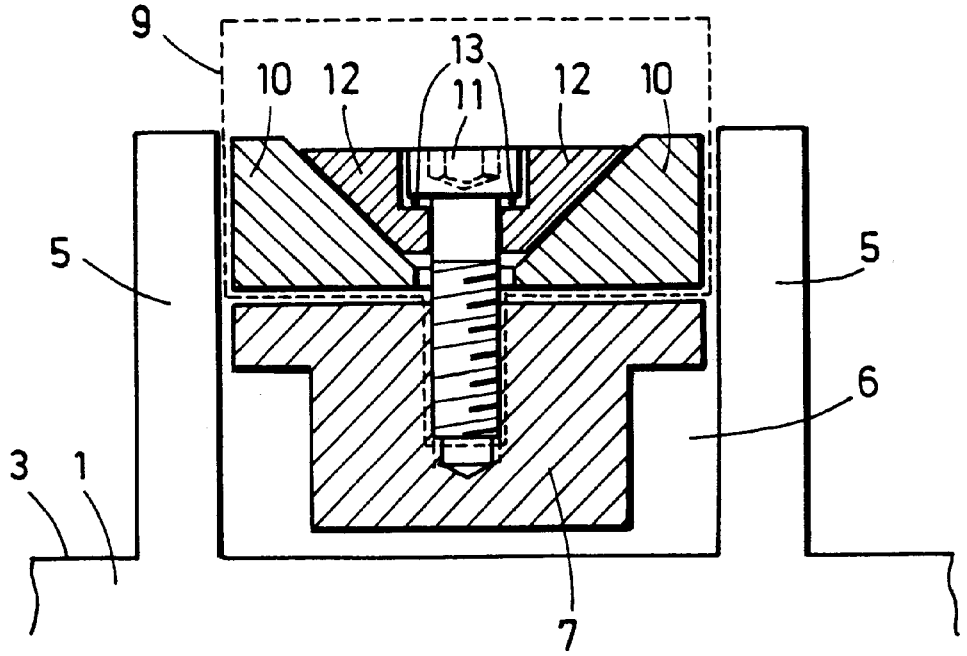
FIG. 3 is an illustration, partially in section, of an expanding element.

The connection between the filler pieces 7 and the inner mold plate 1 is shown in FIG. 3. In accordance with FIG. 3, the filler piece 7 includes an expanding element 9. By means of the expanding element 9, the filler piece 7 can be connected with frictional engagement to the inner mold plate 1 or the webs 5 thereof. For this purpose, the expanding element 9 has two conically tapered expanding plates 10 which can be pressed against the webs by means of a screw 11. As illustrated in FIG. 3, pressing of the expanding plates 10 against the webs 5 can be effected by arranging conically tapered expanding discs 12 between the screw 11 and the expanding plates 10.

In order to ensure that the frictional engagement between the webs 5 and the filler piece 7 is securely maintained even when the mold wall is heated, a spring element 13 is provided at the expanding element 9. In the illustrated embodiment, the spring element 13 is formed as an O-ring of a permanently elastic material between the screw 11 and the disc 12, wherein the O-ring is capable of withstanding the temperatures which occur during continuous casting and which has a sufficient thickness.

The mold wall according to the present invention makes it possible to achieve a plurality of advantages. For example, it is not necessary to provide bores on the rear side of the inner mold plate 1. Also, it is not necessary to place threaded inserts in the inner mold plate. The grooves 6 which serve as cooling ducts may have a uniform spacing therebetween. The used inner plates 1 can be sold for a high scrap price because they are free of steel impurities. Finally, the threaded bolts 8 do not have a thermal influence on the inner mold plate 1 because they are welded not to the inner mold plate 1 but to the filler pieces 7.

While specific embodiments of the invention have been shown and described in detail to illustrate the inventive principles, it will be understood that the invention may be embodied otherwise without departing from such principles.

I claim:

1. A mold wall of a continuous casting mold, the mold wall comprising an inner mold plate, filler pieces and a water box connected to the inner mold plate through screw connections mounted between the filler pieces and the water box, wherein the inner mold plate has webs on a side facing the water box, the webs defining grooves for mounting the filler pieces therebetween, each filler piece comprising at least one expanding element for effecting a frictional connection between the filler piece and the inner mold plate.

2. The mold wall according to claim 1, wherein the expanding element comprises at least one conically tapered expanding plate, further comprising a screw for pressing the expanding plate against one of the webs.

3. The mold wall according to claim 2, further comprising a conically tapered expanding disc mounted between the screw and the expanding plate.

4. The mold wall according to claim 3, further comprising a spring element mounted between the screw and the expanding disc for maintaining the frictional connection when the mold wall is heated.

* * * * *